US010808959B2

(12) United States Patent
Kimura et al.

(10) Patent No.: US 10,808,959 B2
(45) Date of Patent: Oct. 20, 2020

(54) AIR CONDITIONING SYSTEM

(71) Applicant: KIMURA KOHKI CO., LTD., Osaka-shi, Osaka (JP)

(72) Inventors: Keiichi Kimura, Yao (JP); Mitsuo Morita, Nabari (JP); Takayuki Ishida, Yao (JP); Kazuya Goto, Yao (JP); Hidekazu Sato, Osaka (JP)

(73) Assignee: KIMURA KOHKI CO., LTD., Osaka-Shi, Osaka (JP)

( * ) Notice: Subject to any disclaimer, the term of this patent is extended or adjusted under 35 U.S.C. 154(b) by 127 days.

(21) Appl. No.: 16/263,283

(22) Filed: Jan. 31, 2019

(65) Prior Publication Data

US 2019/0234633 A1 Aug. 1, 2019

(30) Foreign Application Priority Data

Feb. 1, 2018 (JP) ..... 2018-16360
Apr. 17, 2018 (JP) ..... 2018-78815

(51) Int. Cl.
*F24F 11/30* (2018.01)
*F24F 11/72* (2018.01)
(Continued)

(52) U.S. Cl.
CPC ..... *F24F 11/30* (2018.01); *F24F 1/0035* (2019.02); *F24F 1/0087* (2019.02); *F24F 3/001* (2013.01);
(Continued)

(58) Field of Classification Search
CPC ..... F24F 1/0035; F24F 1/0087; F24F 3/001; F24F 3/14; F24F 6/02; F24F 6/18;
(Continued)

(56) References Cited

U.S. PATENT DOCUMENTS 10,309,676 B2 * 6/2019 Kimura ..... F24F 13/04
10,502,449 B2 * 12/2019 Kimura ..... F24F 13/10
(Continued)

FOREIGN PATENT DOCUMENTS

JP 2001056146 A 2/2001
JP 2008070097 A 3/2008
(Continued)

*Primary Examiner* — Marc E Norman
(74) *Attorney, Agent, or Firm* — Alleman Hall Creasman & Tuttle LLP

(57) ABSTRACT

An air conditioning system includes: an air conditioner configured to supply air-conditioning air; and an air conditioner control device configured to control the air conditioner. The air conditioner includes: an outside air passage, through which outside air flows; a return air passage, through which return air flows; an outside air heat exchanger; a return air heat exchanger; an outside air vaporizing humidifier configured to humidity the outside air by utilizing evaporation of water; and a return air vaporizing humidifier configured to humidify the return air by utilizing evaporation of water. The air conditioner control device includes a first vaporizing cooler configured to operate at least one of the humidifiers to perform vaporization cooling of the air-conditioning air while preventing the air-conditioning air from exchanging heat with a heat exchange medium.

6 Claims, 8 Drawing Sheets

(51) Int. Cl.

| | |
|---|---|
| ***F24F 6/02*** | (2006.01) |
| ***F24F 6/12*** | (2006.01) |
| ***F24F 3/00*** | (2006.01) |
| ***F24F 1/0035*** | (2019.01) |
| ***F24F 6/18*** | (2006.01) |
| ***F24F 1/0087*** | (2019.01) |
| ***F24F 3/14*** | (2006.01) |
| *F24F 110/12* | (2018.01) |
| *F25B 49/02* | (2006.01) |
| *F24F 5/00* | (2006.01) |
| *F25B 13/00* | (2006.01) |

(52) U.S. Cl.
CPC ..... *F24F 3/14* (2013.01); *F24F 6/02* (2013.01); *F24F 6/18* (2013.01); *F24F 11/72* (2018.01); *F24F 2005/0025* (2013.01); *F24F 2110/12* (2018.01); *F25B 13/00* (2013.01); *F25B 49/022* (2013.01); *F25B 2400/06* (2013.01)

(58) Field of Classification Search
CPC .... F24F 11/30; F24F 11/72; F24F 2005/0025; F24F 2110/12; F25B 13/00; F25B 49/022; F25B 2400/16
See application file for complete search history.

(56) References Cited

U.S. PATENT DOCUMENTS

| | | | | |
|---|---|---|---|---|
| 2013/0098597 | A1* | 4/2013 | Fujimoto ..... | H05K 7/20745 165/287 |
| 2017/0205092 | A1 | 7/2017 | Okajima et al. | |

FOREIGN PATENT DOCUMENTS

| | | | |
|---|---|---|---|
| JP | 4182494 | B2 | 11/2008 |
| JP | 2009162411 | A | 7/2009 |
| JP | 2010025503 | A | 2/2010 |
| JP | 2016217560 | A | 12/2016 |

* cited by examiner

AIR CONDITIONING SYSTEM

CROSS-REFERENCE TO RELATED APPLICATION

This application claims priority to and the benefit of Japanese Patent Application No. 2018-16360, filed on Feb. 1, 2018, and Japanese Patent Application No. 2018-78815, filed on Apr. 17, 2018, the entire disclosure of which are incorporated herein by reference.

BACKGROUND OF THE INVENTION

Field of the Invention

The present invention relates to an air conditioning system.

Description of the Related Art

In air conditioning system industries, generally speaking, a one-year period is divided into a "summer period", a "winter period", and "intermediate periods". Spring and autumn periods are the "intermediate periods". In these intermediate periods, heating and cooling are used less frequently. One of conventional air conditioning systems is disclosed in, for example, Japanese Laid-Open Patent Application Publication No. 2009-162411. The conventional air conditioning system includes two heat exchangers, and causes outside air and return air, both of which serve as air-conditioning air, to undergo heat exchange in the two respective heat exchangers separately. After causing the outside air and the return air to undergo the heat exchange separately, the air conditioning system mixes the outside air and the return air together, and supplies the mixed air to a space to be air conditioned, thereby cooling the space. In an intermediate period in which the outside air temperature is lower than a room air temperature, particularly, for example, in autumn, the air conditioning system stops operating the heat exchangers to stop performing the heat exchange of the air-conditioning air, and instead introduces the outside air into the room, thereby cooling the room by utilizing sensible cooling energy. Since the heat exchange of the air-conditioning air is not performed, energy saving is realized. In the description herein, the term "sensible heat" means heat that causes a change in temperature.

However, the sensible cooling alone, which utilizes the outside air, is limited in terms of cooling performance, and is not necessarily sufficient for cooling the space to be air conditioned. Moreover, although the temperature can be adjusted by the sensible cooling, the humidity cannot be controlled by the sensible cooling. Thus, the sensible cooling alone, which utilizes the outside air, is inferior in terms of comfortableness.

An object of the present invention is to provide an air conditioning system capable of performing air conditioning that realizes comfortableness while keeping energy saving performance.

SUMMARY OF THE INVENTION

An air conditioning system according to one aspect of the present invention includes: an air conditioner configured to adjust air-conditioning air to be in a suitable air condition for air conditioning of a space to be air conditioned, and supply the air-conditioning air to the space to be air conditioned; and an air conditioner control device configured to control operation of the air conditioner. The air conditioner includes: an outside air passage, through which outside air flows; a return air passage, through which return air flows; an outside air heat exchanger, through which a heat exchange medium flows and at which the outside air of the outside air passage exchanges heat with the heat exchange medium; a return air heat exchanger, through which the heat exchange medium flows and at which the return air of the return air passage exchanges heat with the heat exchange medium; an outside air vaporizing humidifier configured to humidify the outside air of the outside air passage by utilizing evaporation of water; and a return air vaporizing humidifier configured to humidify the return air of the return air passage by utilizing evaporation of water. The air conditioner control device includes a first vaporizing cooler configured to operate one of or both the outside air vaporizing humidifier and the return air vaporizing humidifier to perform vaporization cooling of the air-conditioning air while preventing the air-conditioning air from exchanging heat with the heat exchange medium by stopping a flow of the heat exchange medium in the outside air heat exchanger or the return air heat exchanger.

According to the configuration of the above aspect, the air conditioner can perform vaporization cooling of the air-conditioning air by operating one of or both the outside air vaporizing humidifier and the return air vaporizing humidifier while preventing the air-conditioning air from exchanging heat with the heat exchange medium. Therefore, higher cooling performance and higher energy saving performance are realized compared to a case where sensible cooling alone, which utilizes the outside air, is performed. Usually, in an intermediate period or winter period, the air conditioner performs heating operation. However, even in these periods, there are cases where the air conditioner needs to perform cooling operation for the reason that the temperature of the space to be air conditioned is higher than a preset temperature of the space to be air conditioned due to solar radiation and/or the use of equipment that radiates a large amount of heat in the space to be air conditioned. The above-described configuration is useful in such cases. Particularly, for example, in a winter period, water of the return air vaporizing humidifier is evaporated by the return air whose temperature is higher than that of the outside air. This facilitates the vaporization cooling, and thereby cooling performance and humidifying performance are improved.

In another aspect of the present invention, the air conditioning system further includes an air volume adjusting device configured to adjust air volume of the outside air of the outside air passage and air volume of the return air of the return air passage. When operating one of or both the outside air vaporizing humidifier and the return air vaporizing humidifier to perform the vaporization cooling of the air-conditioning air, the first vaporizing cooler operates the air volume adjusting device to adjust the air volume of the outside air of the outside air passage and the air volume of the return air of the return air passage.

According to the above configuration, the air conditioner performs vaporization cooling of one of or both the outside air and the return air while preventing the air-conditioning air from exchanging heat with the heat exchange medium, and adjusts the air volume of mixed air of the outside air and the return air. By merely performing these adjustments, the mixed air of the outside air and the return air can be adjusted to be in suitable air conditions for the air conditioning of the space to be air conditioned. In other words, by merely operating the air volume adjusting device and one of or both the outside air vaporizing humidifier and the return air vaporizing humidifier, both the temperature and humidity of the mixed air can be controlled. This makes it possible to perform comfortable air conditioning while keeping energy saving performance.

In yet another aspect of the present invention, the air conditioning system further includes: a heat storage tank configured to store the heat exchange medium; a heat source machine configured to adjust a temperature of the heat exchange medium, and switch a temperature range of the heat exchange medium to a temperature range suitable for cooling operation of the air conditioner by cooling the heat exchange medium and to a temperature range suitable for heating operation of the air conditioner by heating the heat exchange medium; and a pump configured to circulate the heat exchange medium between the heat source machine and the air conditioner.

According to the above configuration, by cooling the heat exchange medium of the heat storage tank, the air conditioner can be caused to perform cooling operation, and by heating the heat exchange medium of the heat storage tank, the air conditioner can be caused to perform heating operation. That is, the air conditioning system of the present invention can be used also as an ordinary air conditioning system.

In yet another aspect of the present invention, the air conditioning system further includes: a cooling-use heat storage tank configured to store a cooling-use heat exchange medium whose temperature is in a temperature range suitable for cooling air-conditioning operation of the air conditioner; a heating-use heat storage tank configured to store a heating-use heat exchange medium whose temperature is in a temperature range suitable for heating air-conditioning operation of the air conditioner; and a circulating apparatus configured to circulate the cooling-use heat exchange medium between the cooling-use heat storage tank and the air conditioner, and circulate the heating-use heat exchange medium between the heating-use heat storage tank and the air conditioner. The circulating apparatus includes: a cooling-use circulation passage, through which the cooling-use heat exchange medium flows; a heating-use circulation passage, through which the heating-use heat exchange medium flows; and a switching valve configured to switch a passage that is in communication with the air conditioner between the cooling-use circulation passage and the heating-use circulation passage. The air conditioner control device includes a heat exchange medium switcher configured to: compare an actually measured air condition of the space to be air conditioned with a preset air condition; based on a comparison result, determine whether to cause the cooling-use heat exchange medium whose temperature is in the temperature range suitable for the cooling air-conditioning operation to flow through the air conditioner or to cause the heating-use heat exchange medium whose temperature is in the temperature range suitable for the heating air-conditioning operation to flow through the air conditioner; and based on a determination result, switch a state of the switching valve.

According to the above configuration, the air conditioning system: compares the actually measured air condition of the space to be air conditioned with the preset air condition; based on the comparison result, determines whether to cause the cooling-use heat exchange medium of the cooling-use circulation passage to flow through the air conditioner or to cause the heating-use heat exchange medium of the heating-use circulation passage to flow through the air conditioner; and based on the determination result, switches the state of the switching valve. Accordingly, the air-conditioning operation to perform can be automatically switched between the cooling air-conditioning operation and the heating air-conditioning operation. This eliminates troublesomeness and realizes improved convenience.

In yet another aspect of the present invention, the air conditioner control device includes a stored heat temperature adjuster. When a difference between the actually measured air condition of the space to be air conditioned and the preset air condition becomes greater than the difference previously measured at a time of switching the state of the switching valve, if the air conditioner is performing the cooling air-conditioning operation, the stored heat temperature adjuster outputs a signal to lower the temperature range of the heat exchange medium of the cooling-use heat storage tank, and if the air conditioner is performing the heating air-conditioning operation, the stored heat temperature adjuster outputs a signal to raise the temperature range of the heat exchange medium of the heating-use heat storage tank. When the difference between the actually measured air condition of the space to be air conditioned and the preset air condition becomes less than the difference previously measured at the time of switching the state of the switching valve, if the air conditioner is performing the cooling air-conditioning operation, the stored heat temperature adjuster outputs a signal to raise the temperature range of the heat exchange medium of the cooling-use heat storage tank, and if the air conditioner is performing the heating air-conditioning operation, the stored heat temperature adjuster outputs a signal to lower the temperature range of the heat exchange medium of the heating-use heat storage tank.

According to the above configuration, the heat exchange energy possessed by the heat exchange medium of the cooling-use heat storage tank or the heating-use heat storage tank can be adjusted, i.e., increased/decreased, in accordance with the air-conditioning load of the space to be air conditioned. Accordingly, when the air-conditioning load of the space to be air conditioned is high, air conditioning operation using high heat exchange energy is performed by the air conditioner, and thereby the air condition of the space to be air conditioned can be efficiently and quickly adjusted to be the preset air condition. On the other hand, when the air-conditioning load of the space to be air conditioned is low, air conditioning operation using low heat exchange energy is performed by the air conditioner. In this manner, the air condition of the space to be air conditioned can be adjusted to be the preset air condition while suppressing hunting (i.e., air conditioning operation being unstable), overshooting (i.e., excessive increase or decrease of the air conditioning temperature), and wasteful energy consumption caused thereby. This makes it possible to perform comfortable air conditioning while keeping energy saving performance.

The above and other objects, features, and advantages of the present invention will more fully be apparent from the following detailed description of preferred embodiments with accompanying drawings.

DESCRIPTION OF THE PREFERRED EMBODIMENTS

Figure 1:
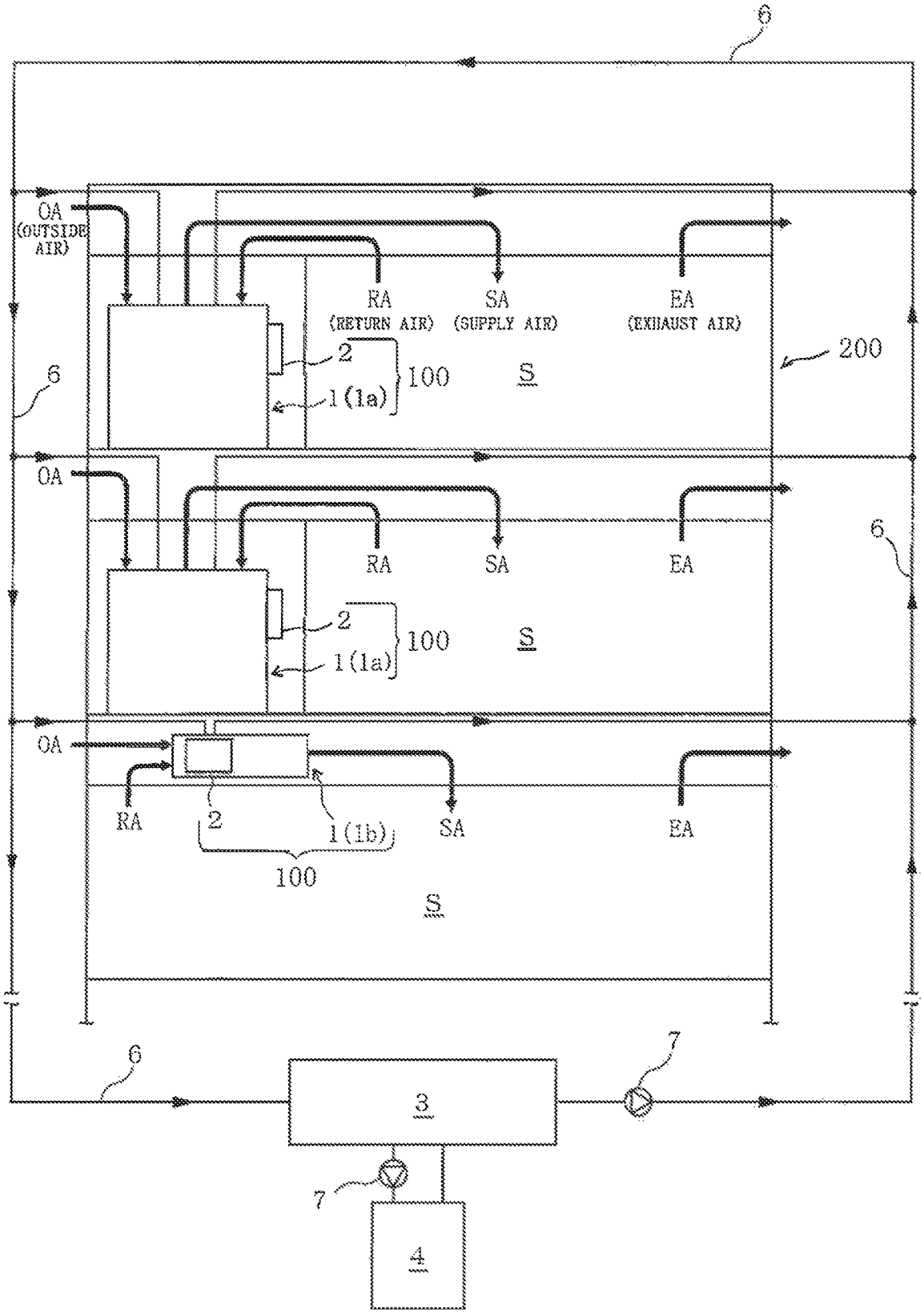
FIG. 1 is a schematic diagram showing a building structure in which an air conditioning system according to the present invention is installed.

FIG. 1 is a schematic diagram showing a building structure 200, in which an air conditioning system 100 according to the present invention is installed. The building structure 200 has three floors therein vertically. On each of the three floors, there is a space S to be air conditioned, such as a room or a hall. The air conditioning system 100 is installed in each space S to be air conditioned. The air conditioning system 100 includes: an air conditioner 1 (specifically, an air conditioner 1*a* or 1*b*) configured to adjust outside air, return air, and other air-conditioning air to be in suitable air conditions for air conditioning of the space S to be air conditioned, and supply the air in the suitable air conditions to the space S to be air conditioned; and an air conditioner control device 2 configured to control the operation of the air conditioner 1. The air conditioner 1 introduces therein, as air-conditioning air, outside air (OA) from the outside of the building structure 200 and return air (RA) from the space S to be air conditioned, and supplies supply air (SA) from the air conditioner 1 as air-conditioning air to the space S to be air conditioned. In the drawings, each solid bold arrow indicates the direction of an air flow. It should be noted that the spaces S to be air conditioned are not limited to three floors arranged vertically. In each space S to be air conditioned, the air conditioning system 100 may be installed, for example, on the floor (as shown in the upper two floors of FIG. 1) or inside the ceiling (as shown in the bottom floor of FIG. 1).

A circulation conduit 6, through which a heat exchange medium such as water or an aqueous solution circulates, is provided around the building structure 200. Each air conditioner 1 is connected to the circulation conduit 6. A pump 7 configured to circulate the heat exchange medium and a heat storage tank 3 configured to store the heat exchange medium are provided on the circulation conduit 6. A heat source machine 4 is connected to the heat storage tank 3. The heat source machine 4 is configured to adjust the temperature of the heat exchange medium by heating or cooling it, and switch the temperature range of the heat exchange medium to a temperature range suitable for cooling operation of the air conditioner by cooling the heat exchange medium and to a temperature range suitable for heating operation of the air conditioner by heating the heat exchange medium. The heat source machine 4 is an electric chiller-heater unit. For example, the heat source machine 4 is operated at night, and the heat exchange medium is stored in the heat storage tank 3 at the time. The stored heat exchange medium is later used for the operation of the air conditioner 1.

Embodiment 1

Figure 2:
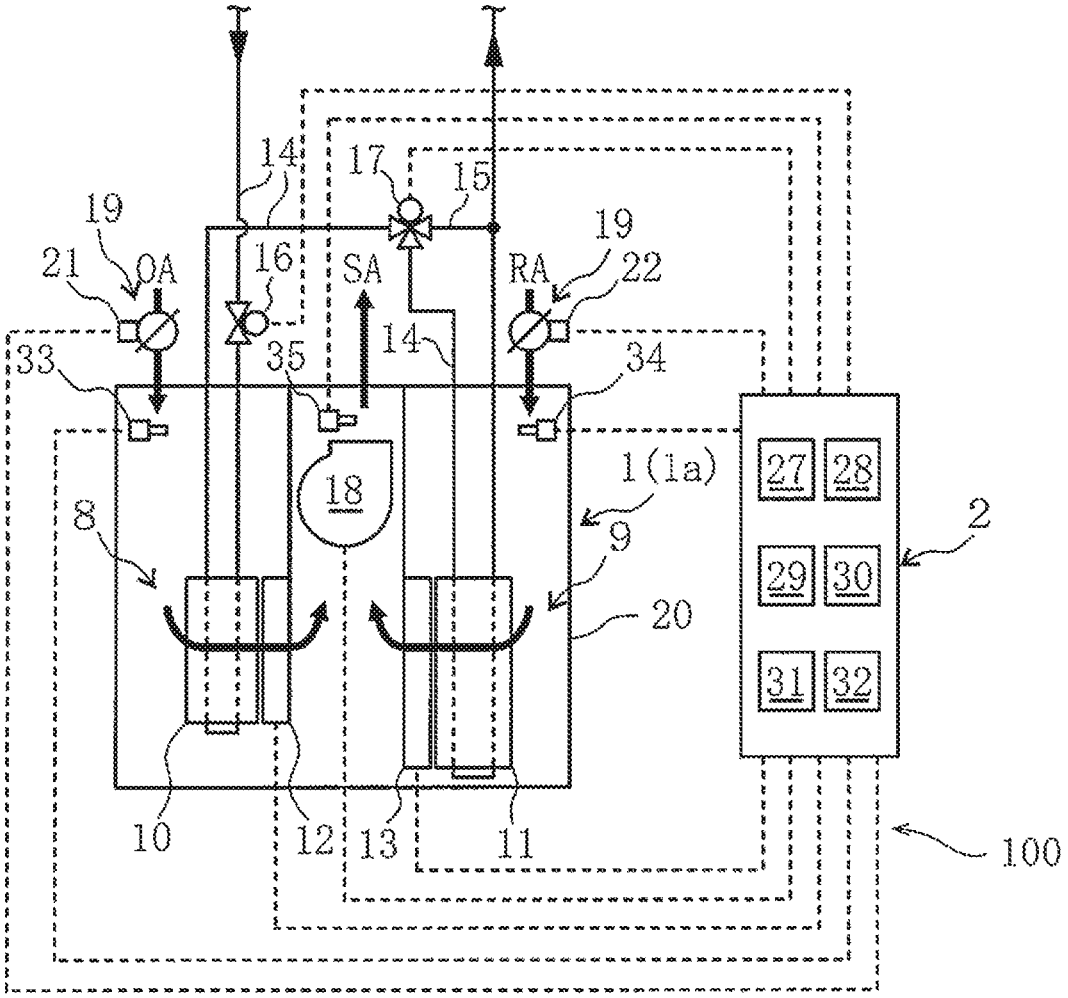
FIG. 2 shows the internal configuration of an air conditioner.

FIG. 2 shows the internal configuration of the air conditioner 1. The air conditioner 1 includes: an outside air passage 8, through which outside air serving as air-conditioning air flows; and a return air passage 9, through which return air serving as air-conditioning air flows. The air conditioner 1 includes the following components in its casing 20: an outside air heat exchanger 10, at which the outside air serving as air-conditioning air exchanges heat with the heat exchange medium; a return air heat exchanger 11, at which the return air serving as air-conditioning air exchanges heat with the heat exchange medium; an outside air vaporizing humidifier 12 configured to humidify the outside air of the outside air passage 8 by utilizing evaporation of water; a return air vaporizing humidifier 13 configured to humidify the return air of the return air passage 9 by utilizing evaporation of water; and an air blower 18. Each humidifier 12 or 13 performs the humidification when power to the humidifier is turned on, and stops the humidification when power to the humidifier is turned off. The heat exchange medium in the circulation conduit 6 flows through a first conduit 14 and a second conduit 15, and is taken into the air conditioner 1. A first flow regulating valve 16 and a second flow regulating valve 17 are provided on the conduit 14 and the conduit 15. The first flow regulating valve 16 and the second flow regulating valve 17 are, for example, solenoid valves that open/close when power thereto is turned on/off. Outside the casing 20, an air volume adjusting device 19 is provided, which is configured to adjust the air volume of the outside air of the outside air passage 8 and the air volume of the return air of the return air passage 9. The air volume adjusting device 19 includes an outside air damper 21 and a return air damper 22 each configured to adjust the air volume of the passing air.

The outside air heat exchanger 10 performs a first process of cooling or heating the outside air serving as air-conditioning air by utilizing the heat exchange medium that flows through the outside air heat exchanger 10. The return air heat exchanger 11 performs a second process of cooling or heating the return air serving as air-conditioning air by utilizing the heat exchange medium that flows through the return air heat exchanger 11. The first conduit 14 is configured to cause the heat exchange medium to flow through the outside air heat exchanger 10 and the return air heat exchanger 11 in this order consecutively. The second conduit 15 branches off from the first conduit 14, and is configured to cause the heat exchange medium that has been used in the first process to flow in a manner to bypass the return air heat exchanger 11.

The first flow regulating valve 16 is provided on the first conduit 14 at a position upstream of the second flow regulating valve 17, and the second flow regulating valve 17 is provided at a branch point where the first conduit 14 and the second conduit 15 branch off, the branch point being upstream of the return air heat exchanger 11. The first flow regulating valve 16 is configured as a proportional control two-way valve that varies the flow rate of the heat exchange medium before the first process to adjust the performance of the outside air heat exchanger 10 in the first process. The second flow regulating valve 17 is configured as a proportional control three-way valve that varies the flow rate distribution of the heat exchange medium between the first conduit 14 and the second conduit 15 to adjust the performance of the return air heat exchanger 11 in the second process. The second flow regulating valve 17 may be configured as a three-way valve whose only function is to switch the flow of the heat exchange medium, such that the entire amount of the heat exchange medium flows through one of the first conduit 14 and the second conduit 15 while no heat exchange medium flows through the other one of the conduits. It should be noted that the first flow regulating valve 16 and the second flow regulating valve 17 are not limited to the two-way valve and the three-way valve, but may be configured as different types of valves.

The outside air vaporizing humidifier 12 is provided downwind of the outside air heat exchanger 10, and the return air vaporizing humidifier 13 is provided downwind of the return air heat exchanger 11. The outside air damper 21 adjusts, i.e., increases/decreases, the air volume of the outside air serving as air-conditioning air subjected to the first process. The return air damper 22 adjusts, i.e., increases/decreases, the air volume of the return air serving as air-conditioning air subjected to the second process. The outside air serving as air-conditioning air flows through the outside air damper 21, the outside air heat exchanger 10, and the outside air vaporizing humidifier 12. The return air serving as air-conditioning air flows through the return air damper 22, the return air heat exchanger 11, and the return air vaporizing humidifier 13. Mixed air of the outside air and the return air is supplied by the air blower 18 to the space S to be air conditioned.

Figure 3:
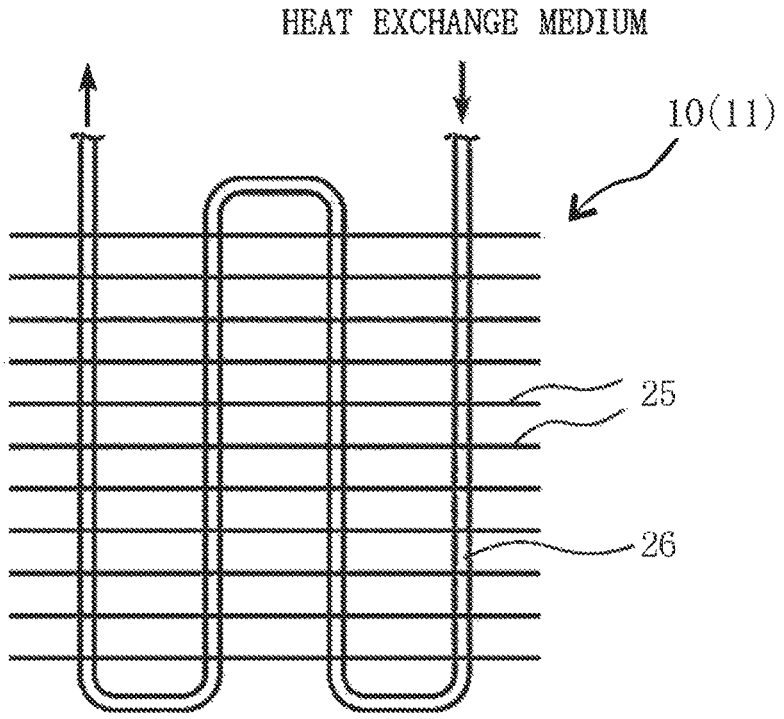
FIG. 3 shows the configuration of each of heat exchangers.

FIG. 3 shows the configuration of each of the heat exchangers 10 and 11. The outside air heat exchanger 10 and the return air heat exchanger 11 are configured in the same manner. Similar to a known plate fin coil, each of these heat exchangers is formed by attaching a plurality of heat transfer pipes 26 to a plurality heat transfer plates 25 by insertion. The heat exchange medium, which is either cold water or hot water, is flowed through the heat transfer pipes 26, and the air-conditioning air is brought into contact with the heat transfer pipes 26 and the heat transfer plates 25. Accordingly, the air-conditioning air and the heat exchange medium exchange heat with each other, and thereby the air-conditioning air is cooled or heated.

The air conditioner control device 2 controls the operation of the first flow regulating valve 16, the second flow regulating valve 17, the outside air vaporizing humidifier 12, the return air vaporizing humidifier 13, the air volume adjusting device 19, and the air blower 18 in accordance with variation in the air-conditioning load of the space S to be air conditioned, thereby adjusting the air-conditioning air to be in suitable air conditions (suitable temperature and humidity) for the air conditioning of the space S to be air conditioned.

The air conditioner control device 2 is formed by a microprocessor, various sensors, and other control devices, and includes: an air condition detector 27 configured to detect the temperature and humidity of the air-conditioning air; a temperature/humidity setter 28 configured to set a preset temperature and preset humidity that are air conditioning targets of the space S to be air conditioned; a first air conditioning performance controller 29; an air conditioning performance compensator 30; a first vaporizing cooler 31; and an outside air cooling controller 32. The air condition detector 27 is connected to: an outside air sensor 33 configured to detect the temperature and humidity of the outside air of the outside air passage 8; a return air sensor 34 configured to detect the temperature and humidity of the return air of the return air passage 9; and a supply air sensor 35 configured to detect the temperature and humidity of the supply air to the space S to be air conditioned, the supply air being mixed air of the outside air and the return air. A user can input the preset temperature and preset humidity to the temperature/humidity setter 28.

In accordance with variation in the air-conditioning load of the space S to be air conditioned, the first air conditioning performance controller 29 switches a control to perform between a first control and a second control by opening/closing the first flow regulating valve 16 and the second flow regulating valve 17 by turning on/off power to the first flow regulating valve 16 and the second flow regulating valve 17. The first control is a control of causing the heat exchange medium to flow through both the outside air heat exchanger 10 and the return air heat exchanger 11. The second control is a control of causing the heat exchange medium to flow only through the outside air heat exchanger 10. For example, in a case where only performing the first process by the outside air heat exchanger 10 is not enough to obtain sufficient cooling or heating performance for cooling or heating the space S to be air conditioned, the second process can also be performed by the return air heat exchanger 11 to compensate for the deficiency in performance.

As thus described, in accordance with variation in the air-conditioning load of the space S to be air conditioned, the air-conditioning air can be precisely and finely adjusted to be in suitable air conditions for the air conditioning of the space S to be air conditioned. For example, when the air-conditioning load decreases from the initial state, the first air conditioning performance controller 29 operates the two flow regulating valves 16 and 17 in a manner to close them, such that the flow rate of the heat exchange medium decreases in accordance with the amount of decrease in the air-conditioning load. When the air-conditioning load further decreases, the first air conditioning performance controller 29 closes the second flow regulating valve 17 to cause the heat exchange medium to flow in a manner to bypass the return air heat exchanger 11, and operates the first flow regulating valve 16 to cause the heat exchange medium to flow only through the outside air heat exchanger 10.

The air conditioning performance compensator 30 calculates an enthalpy required for the first process performed by the outside air heat exchanger 10 and an enthalpy required for the second process performed by the return air heat exchanger 11, and compares these enthalpies. As is well known, the term enthalpy herein means the amount of heat (energy) in air. As described below, the enthalpies are calculated based on the temperature and humidity detected by the outside air sensor 33 and the temperature and humidity detected by the return air sensor 34.

Next, the air conditioning performance compensator 30 operates the outside air damper 21 and the return air damper 22 to decrease the air volume of the air-conditioning air subjected to the first or second process that requires a greater enthalpy and increase the air volume of the air-conditioning air subjected to the first or second process that requires a less enthalpy. The enthalpy required for the first process means an enthalpy required for cooling or heating the air-conditioning air that has not undergone the first process to a preset temperature. The enthalpy required for the second process means an enthalpy required for cooling or heating the air-conditioning air that has not undergone the second process to the preset temperature.

For example, in a case where the enthalpy required for the first process (the process of heating or cooling the outside air by the outside air heat exchanger 10) is less than the enthalpy required for the second process (the process of heating or cooling the return air by the return air heat exchanger 11), the air volume of the outside air before the first process is increased, and the air volume of the return air before the second process is decreased. In this manner, wasteful use of cooling or heating energy is reduced. The enthalpy required for the first process and the enthalpy required for the second process are calculated based on the temperature and humidity detected by the outside air sensor 33 and the temperature and humidity detected by the return air sensor 34. Thus, the air volume of the air-conditioning air subjected to the process that requires a greater enthalpy is decreased, and the air volume of the air-conditioning air subjected to the process that requires a less enthalpy is increased. Consequently, an unnecessary air-conditioning load is reduced, and energy saving can be realized.

The first vaporizing cooler 31 operates one of or both the outside air vaporizing humidifier 12 and the return air vaporizing humidifier 13 by turning on power to the outside air vaporizing humidifier 12 and/or the return air vaporizing humidifier 13 while preventing the air-conditioning air from exchanging heat with the heat exchange medium. In this manner, vaporization cooling of the air-conditioning air is performed. Further, the first vaporizing cooler 31 operates one of or both the outside air vaporizing humidifier 12 and the return air vaporizing humidifier 13 by turning on power to the outside air vaporizing humidifier 12 and/or the return air vaporizing humidifier 13 to perform vaporization cooling of the air-conditioning air, and also operates the air volume adjusting device 19 to adjust the air volume of the outside air of the outside air passage 8 and the air volume of the return air of the return air passage 9. In this manner, the mixed air of the outside air of the outside air passage 8 and the return air of the return air passage 9 is adjusted to be in suitable air conditions for the air conditioning of the space S to be air conditioned.

For example, when the humidity detected by the outside air sensor 33 and the humidity detected by the return air sensor 34 are compared with the preset humidity of the space S to be air conditioned, if the humidity of the outside air of the outside air passage 8 is lower than the preset humidity of the space S to be air conditioned, the first vaporizing cooler 31 stops the flow of the heat exchange medium in the outside air heat exchanger 10, and operates the outside air vaporizing humidifier 12 to subject the outside air to vaporization cooling within such a range that the humidity of the outside air does not exceed the preset humidity. Further, if the humidity of the return air of the return air passage 9 is lower than the preset humidity of the space S to be air conditioned, the first vaporizing cooler 31 stops the flow of the heat exchange medium in the return air heat exchanger 11, and operates the return air vaporizing humidifier 13 to subject the return air to vaporization cooling within such a range that the humidity of the return air does not exceed the preset humidity.

Figure 4:
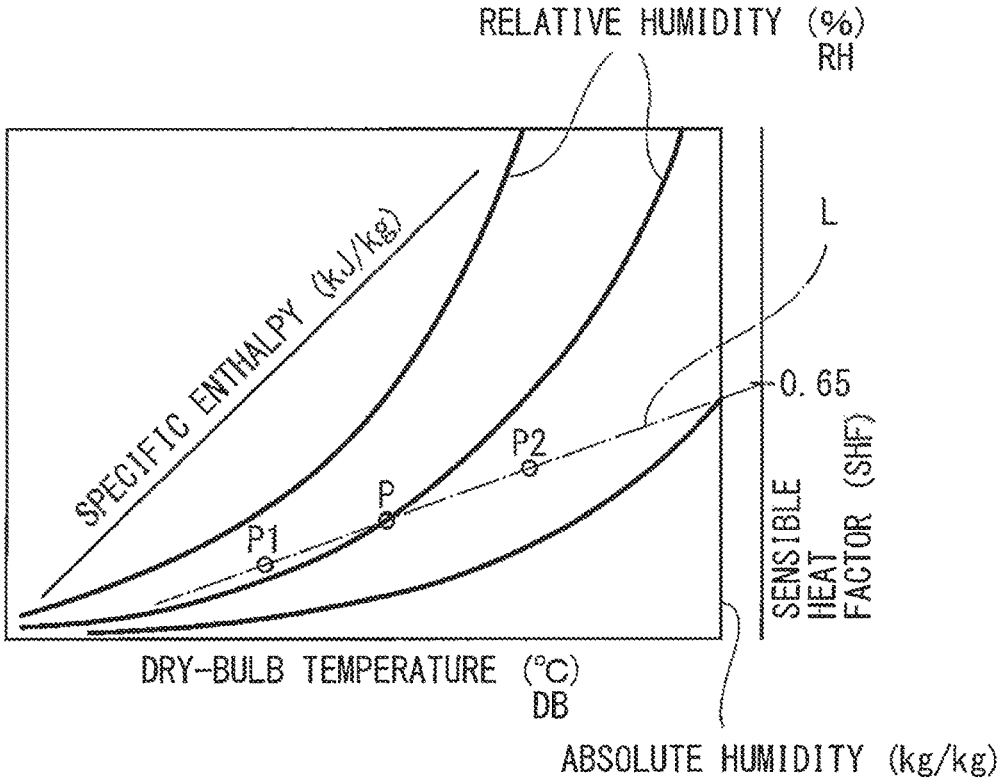
FIG. 4 is a general psychrometric chart.

FIG. 4 is a general psychrometric chart whose horizontal axis represents dry-bulb temperature (° C.) (DB) and whose vertical axis represents absolute humidity (kg/kg) and sensible heat factor (SHF). In FIG. 4, a point indicating a target temperature and target humidity of the supply air is P, and it is assumed that the sensible heat factor of the supply air is 0.65. The sensible heat factor is the ratio of the amount of sensible heat, which is a necessary amount of heat for the air temperature to increase or decrease, to the total amount of heat. In FIG. 4, a line that passes the point P at the sensible heat factor of 0.65 is L. Through the above-described operation of the first vaporizing cooler 31, a point P1 indicating the temperature and humidity of the outside air and a point P2 indicating the temperature and humidity of the return air are caused to reach and be on the line L. The first vaporizing cooler 31 detects the temperature and humidity of mixed air of the outside air and the return air (i.e., supply air to the space S to be air conditioned) by the supply air sensor 35, compares the detected temperature and humidity with the preset temperature and preset humidity, and operates the air volume adjusting device 19 such that the supply air is in suitable air conditions for the air conditioning of the space S to be air conditioned (the suitable air conditions are the target temperature and target humidity of the supply air to the space S to be air conditioned, which are indicated by the point P). Through the operation of the air volume adjusting device 19, the air volume of the outside air and the air volume of the return air are increased/decreased to move a point indicating the temperature and humidity of the mixed air along the line L, thereby causing the point to reach and coincide with the point P, which indicates the target temperature and target humidity of the supply air. It should be noted that the value of the sensible heat factor, the position of the point P1 of the outside air, and the position of the point P2 of the return air in FIG. 4 are merely examples. The positions of the points P1 and P2 may be reversed right and left in FIG. 4.

The outside air cooling controller 32 compares the preset temperature of the space S to be air conditioned with the temperature of the outside air of the outside air passage 8 while preventing the air-conditioning air from exchanging heat with the heat exchange medium. The air volume adjusting device 19 and the air blower 18 are operated within such a range that the temperature of the outside air does not exceed the preset temperature, thereby supplying the outside air to the space S to be air conditioned. In this manner, outside air cooling of the space S to be air conditioned is performed.

In a case where the heat exchange medium is cold water and cooling operation requiring dehumidification is performed in a summer period, the outside air cooling controller 32 opens the first flow regulating valve 16 and the second flow regulating valve 17 to cool and dehumidify the outside air by the outside air heat exchanger 10, and mixes the cooled and dehumidified outside air with the return air that has been cooled by the return air heat exchanger 11 without being dehumidified, thereby controlling the temperature and humidity of the supply air to be the target temperature and target humidity. When cooling operation that does not require dehumidification of the outside air is performed, the outside air cooling controller 32 may turn on power to the outside air vaporizing humidifier 12 and the return air vaporizing humidifier 13, and thereby vaporization cooling by the humidifiers 12 and 13 may also be utilized in the cooling operation. As a result, energy saving can be realized.

In a case where the heat exchange medium is hot water and heating operation is performed in a winter period, the first air conditioning performance controller 29 opens/closes the first flow regulating valve 16 and the second flow regulating valve 17 to heat the outside air by the outside air heat exchanger 10 and heat the return air by the return air heat exchanger 11. The first air conditioning performance controller 29 humidifies the outside air and the return air by the outside air vaporizing humidifier 12 and the return air vaporizing humidifier 13 as necessary, and mixes the outside air and the return air together, thereby controlling the temperature and humidity of the supply air to be the target temperature and target humidity. In a case where the heat exchange medium is hot water and cooling operation is performed in a winter period, the first air conditioning performance controller 29 heats, or does not heat, the outside air whose temperature is lower than the temperature of the space S to be air conditioned by the outside air heat exchanger 10 to a suitable temperature for the cooling, and meanwhile, directly supplies the return air to the space S to be air conditioned without heating it by the return air heat exchanger 11. In this manner, outside air cooling is performed. In this case, the outside air and the return air are humidified by the outside air vaporizing humidifier 12 and the return air vaporizing humidifier 13 as necessary. Here, by humidifying the return air having a high temperature, the amount of humidity can be increased even with the vaporizing humidifier.

Embodiment 2

Figure 5:
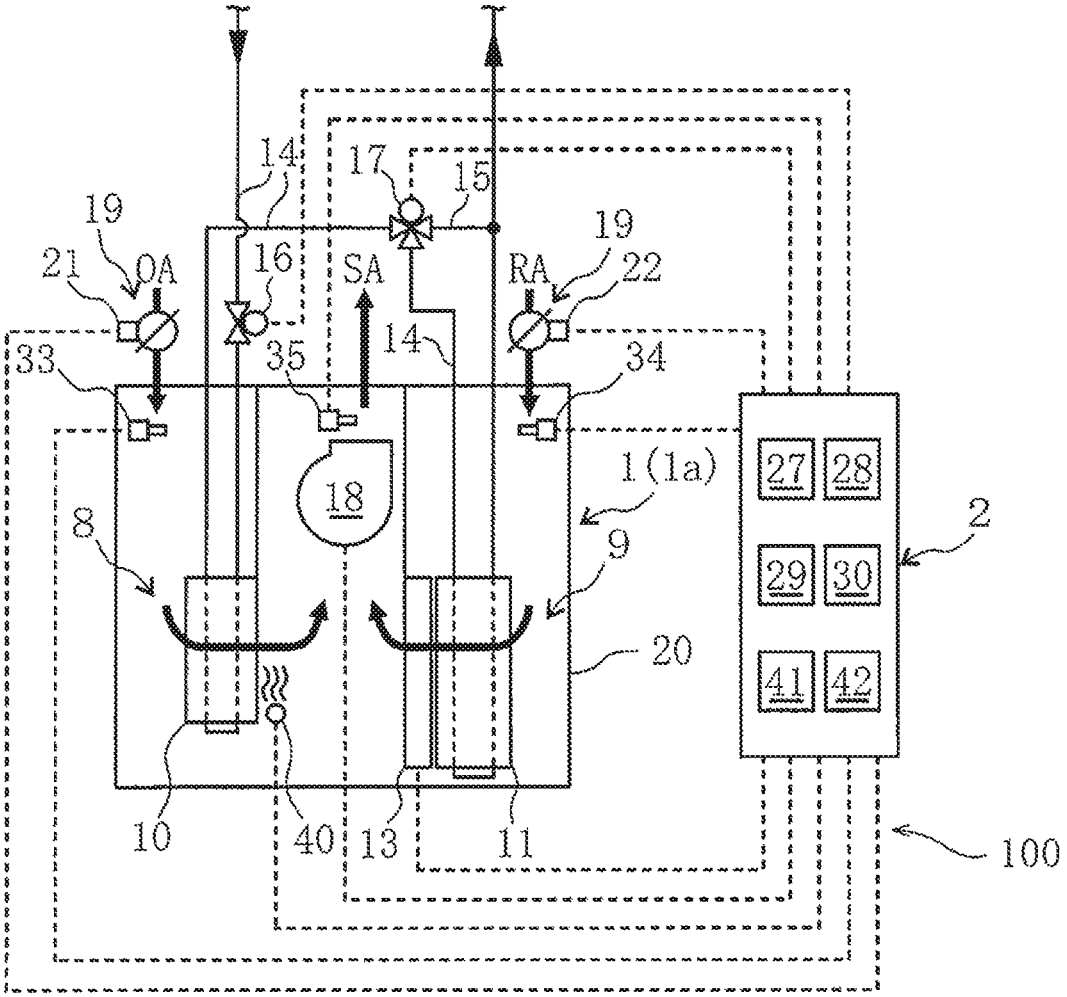
FIG. 5 shows the internal configuration of the air conditioner according to another embodiment.

FIG. 5 shows a configuration that is a result of eliminating the outside air vaporizing humidifier 12 from the air conditioner 1 shown in FIG. 2, and instead, incorporating a steam humidifier 40 into the air conditioner 1 shown in FIG. 2. The steam humidifier 40 is configured to humidify, between the air-conditioning air of the outside air passage 8 and the air-conditioning air of the return air passage 9, at least the air-conditioning air (outside air) of the outside air passage 8 by utilizing steam. In addition, the air conditioner control device 2 includes, instead of the first vaporizing cooler 31, the following components: a humidifying heater 41 configured to operate the steam humidifier 40 to heat the air-conditioning air while preventing the air-conditioning air from exchanging heat with the heat exchange medium; and a second vaporizing cooler 42 configured to operate the return air vaporizing humidifier 13 to perform vaporization cooling of the return air while preventing the air-conditioning air from exchanging heat with the heat exchange medium. In FIG. 5, the steam humidifier 40 is provided downwind of only the outside air heat exchanger 10. However, the steam humidifier 40 may be provided not only downwind of the outside air heat exchanger 10 but also downwind of the return air heat exchanger 11.

The second vaporizing cooler 42 operates the return air vaporizing humidifier 13 to perform vaporization cooling of the return air, such that mixed air of the outside air of the outside air passage 8 and the return air of the return air passage 9 is adjusted to be in suitable air conditions for the air conditioning of the space S to be air conditioned. The second vaporizing cooler 42 also operates the air volume adjusting device 19 to adjust the air volume of the outside air of the outside air passage 8 and the air volume of the return air of the return air passage 9.

For example, when the humidity of the return air detected by the return air sensor 34 is compared with the preset humidity of the space S to be air conditioned, if the humidity of the return air of the return air passage 9 is lower than the preset humidity of the space S to be air conditioned, the second vaporizing cooler 42 stops the flow of the heat exchange medium in the return air heat exchanger 11, and operates the return air vaporizing humidifier 13, thereby performing vaporization cooling of the return air within such a range that the humidity of the return air does not exceed the preset humidity. Accordingly, as previously described with reference to the psychrometric chart of FIG. 4, the air volume adjusting device 19 is operated such that the temperature and humidity of mixed air of the outside air and the return air (i.e., supply air to the space S to be air conditioned) are suitable air conditions for the air conditioning of the space S to be air conditioned (the suitable air conditions are the target temperature and target humidity of the supply air to the space S to be air conditioned, which are indicated by the point P).

The humidifying heater 41, for example, compares the humidity of the outside air detected by the outside air sensor 33 with the preset humidity of the space S to be air conditioned, and if the humidity of the outside air of the outside air passage 8 is lower than the preset humidity of the space S to be air conditioned, stops the flow of the heat exchange medium in the outside air heat exchanger 10. The humidifying heater 41 operates the steam humidifier 40 to heat the outside air within such a range that the humidity of the outside air does not exceed the preset humidity. If the space S to be air conditioned needs to be humidified, the humidifying heater 41 first humidifies the air-conditioning air by the return air vaporizing humidifier 13, which consumes less energy, and if the humidification by the return air vaporizing humidifier 13 alone is insufficient, the humidifying heater 41 also performs humidification by the steam humidifier 40 at least for compensating for the insufficiency. This makes it possible to realize both improvement in humidification precision and reduction of energy consumption. Since the other configuration features and operation examples of Embodiment 2 are the same as those of the embodiment shown in FIG. 2, the description thereof is omitted.

Usually, in an intermediate period or winter period, the air conditioner 1 performs heating operation. However, even in these periods, there are cases where the temperature of the space S to be air conditioned is higher than the preset temperature of the space S to be air conditioned due to solar radiation and/or the use of equipment that radiates a large amount of heat in the space S to be air conditioned. In such cases, the air conditioner 1 may need to perform cooling operation. According to the embodiment shown in FIG. 5, the air conditioner 1 is capable of performing vaporization cooling of the air-conditioning air by operating the return air vaporizing humidifier 13 while preventing the air-conditioning air from exchanging heat with the heat exchange medium. This realizes high cooling performance and high energy saving performance. Particularly, for example, in a winter period, water of the return air vaporizing humidifier 13 is evaporated by the return air whose temperature is higher than that of the outside air. This facilitates the vaporization cooling, and thereby cooling performance and humidifying performance are improved. In an intermediate period or a low air-conditioning load period, the air conditioner 1 is capable of selectively switching the operation to perform between the heating operation of heating the air-conditioning air by the steam humidifier 40 and the cooling operation of performing vaporization cooling of the air-conditioning air by the return air vaporizing humidifier 13, while preventing the air-conditioning air from exchanging heat with the heat exchange medium. This makes it possible to improve both energy saving performance and air conditioning comfortableness.

Embodiment 3

Figure 6:
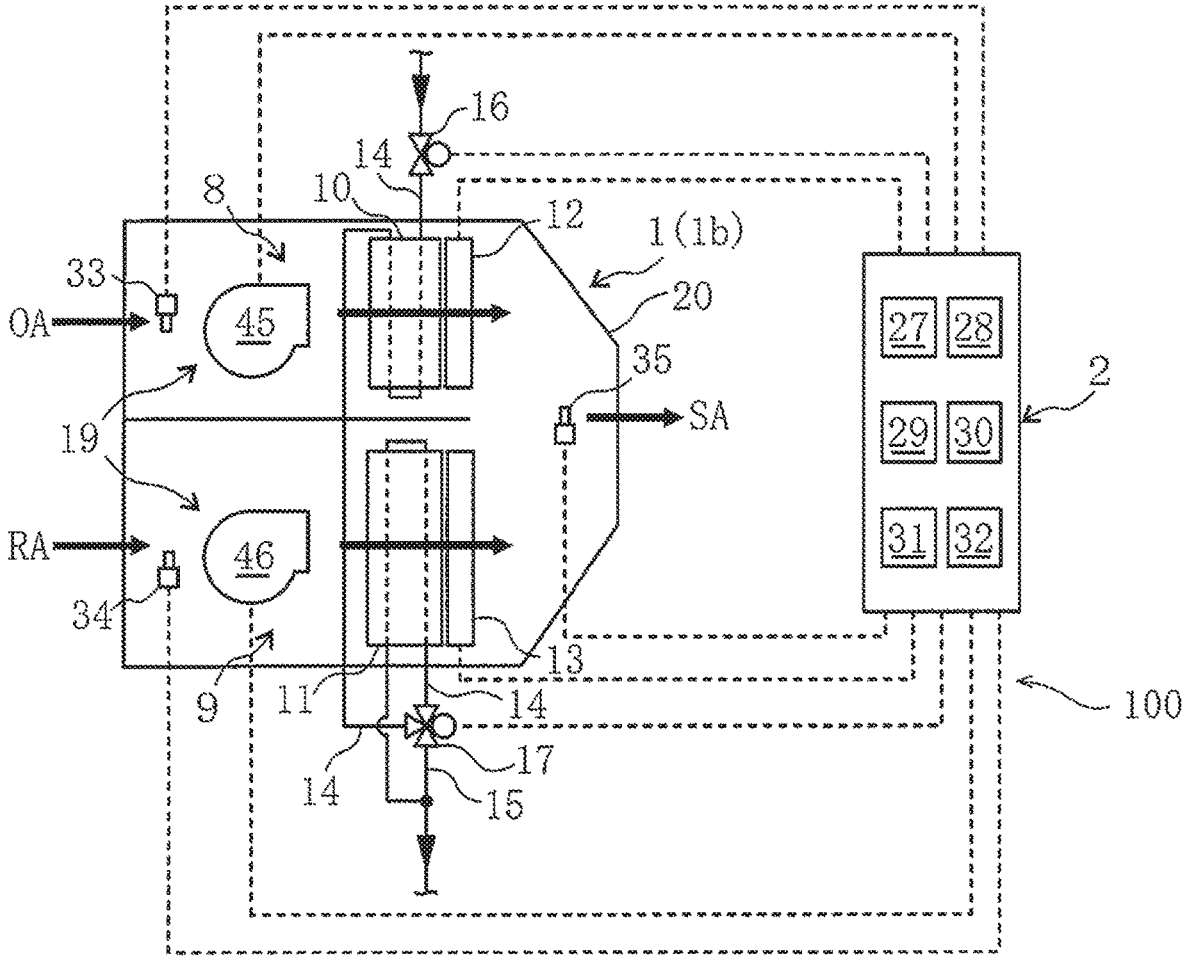
FIG. 6 shows the internal configuration of the air conditioner according to yet another embodiment.

FIG. 6 shows a configuration that is a result of eliminating the outside air damper 21, the return air damper 22, and the air blower 18 from the embodiment shown in FIG. 2, and instead, incorporating an outside-air blower 45 provided on the outside air passage 8 and a return-air blower 46 provided on the return air passage 9 into the embodiment shown in FIG. 2. The outside-air blower 45 and the return-air blower 46 serve as the air volume adjusting device 19. The outside-air blower 45 and the return-air blower 46 are capable of adjusting the air volume of the outside air of the outside air passage 8 and the air volume of the return air of the return air passage 9 through the control of increasing/decreasing the rotational speed of each of the blowers 45 and 46. Since the other configuration features and operation examples of Embodiment 3 are the same as those of the embodiment shown in FIG. 2, the description thereof is omitted.

Embodiment 4

Figure 7:
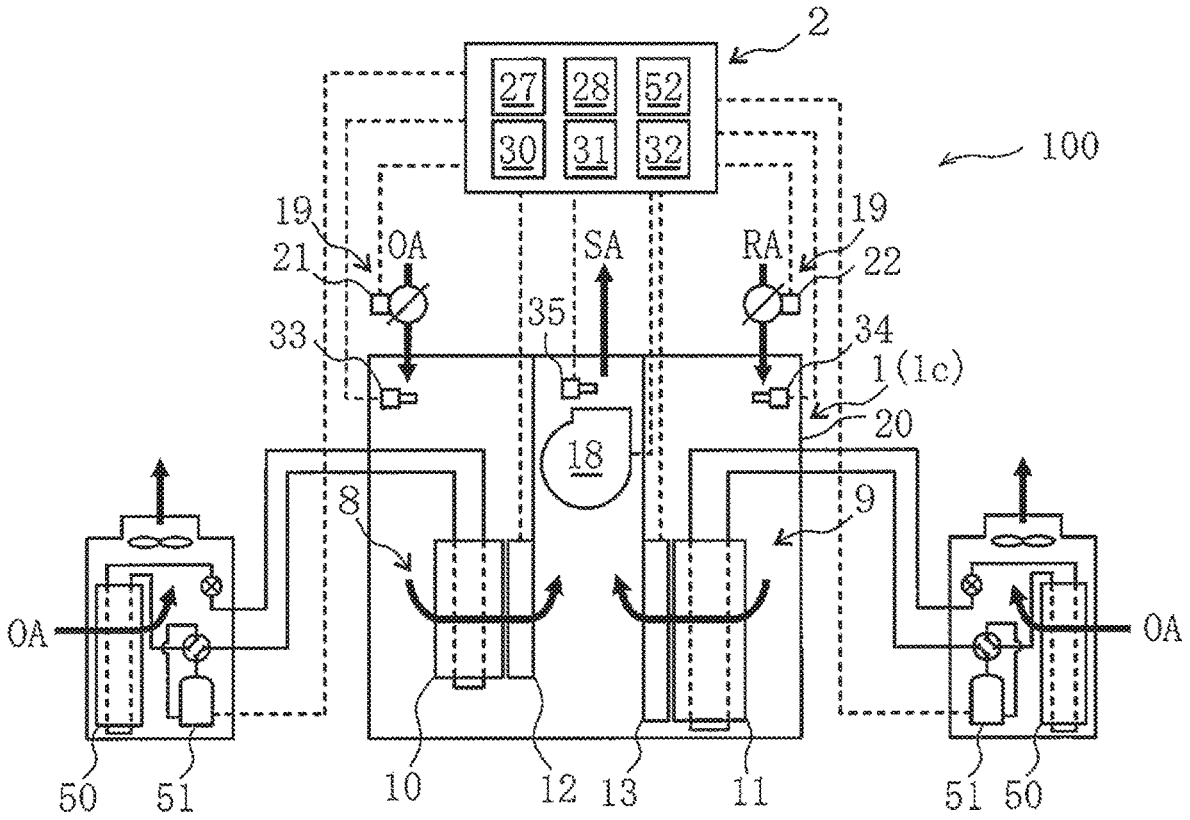
FIG. 7 shows the internal configuration of the air conditioner according to yet another embodiment.

FIG. 7 shows the configuration of an air conditioner 1 (1*c*), which is a result of eliminating the heat storage tank 3, the heat source machine 4, the first conduit 14, the second conduit 15, the first flow regulating valve 16, and the second flow regulating valve 17 from the embodiment shown in FIG. 2, and instead, incorporating heat pumps each using the heat exchange medium as a refrigerant into the embodiment shown in FIG. 2. Each of the outside air heat exchanger 10 and the return air heat exchanger 11 forms a heat pump together with a heat-source-side heat exchanger 50, a compressor 51, and other devices. By operating the compressors 51, the air-conditioning air is caused to exchange heat with the refrigerants via the outside air heat exchanger 10 and the return air heat exchanger 11.

The air conditioner control device 2 includes, instead of the first air conditioning performance controller 29, a second air conditioning performance controller 52 configured to adjust the outside air and the return air through the control of increasing/decreasing the rotational speed of each of the compressors 51, such that the air-conditioning air is in suitable air conditions for the air conditioning of the space S to be air conditioned. Since the other configuration features and operation examples of Embodiment 4 are the same as those of the embodiment shown in FIG. 2, the description thereof is omitted. In FIG. 7, each of the heat pumps is configured as a separate type heat pump, which is divided into an outdoor unit side and an indoor unit side. However, as an alternative, each heat pump may be configured such that both the outdoor-unit-side components and the indoor-unit-side components of the heat pump are provided in the casing 20, and air for heat exchange may be fed to the heat-source-side heat exchanger 50 through a duct.

It should be noted that the present invention is not limited to the above-described embodiment. Although not illustrated, in the embodiment shown in FIG. 7, instead of the outside air vaporizing humidifier 12, a steam humidifier may be provided, which is configured to humidify, between the air-conditioning air of the outside air passage 8 and the air-conditioning air of the return air passage 9, at least the air-conditioning air (outside air) of the outside air passage 8 by utilizing steam. In addition, the air conditioner control device 2 may include, instead of the first vaporizing cooler 31, the following components: a humidifying heater configured to operate the steam humidifier to heat the air-conditioning air; and a second vaporizing cooler configured to operate the return air vaporizing humidifier 13 to perform vaporization cooling of the air-conditioning air.

Embodiment 5

Figure 8:
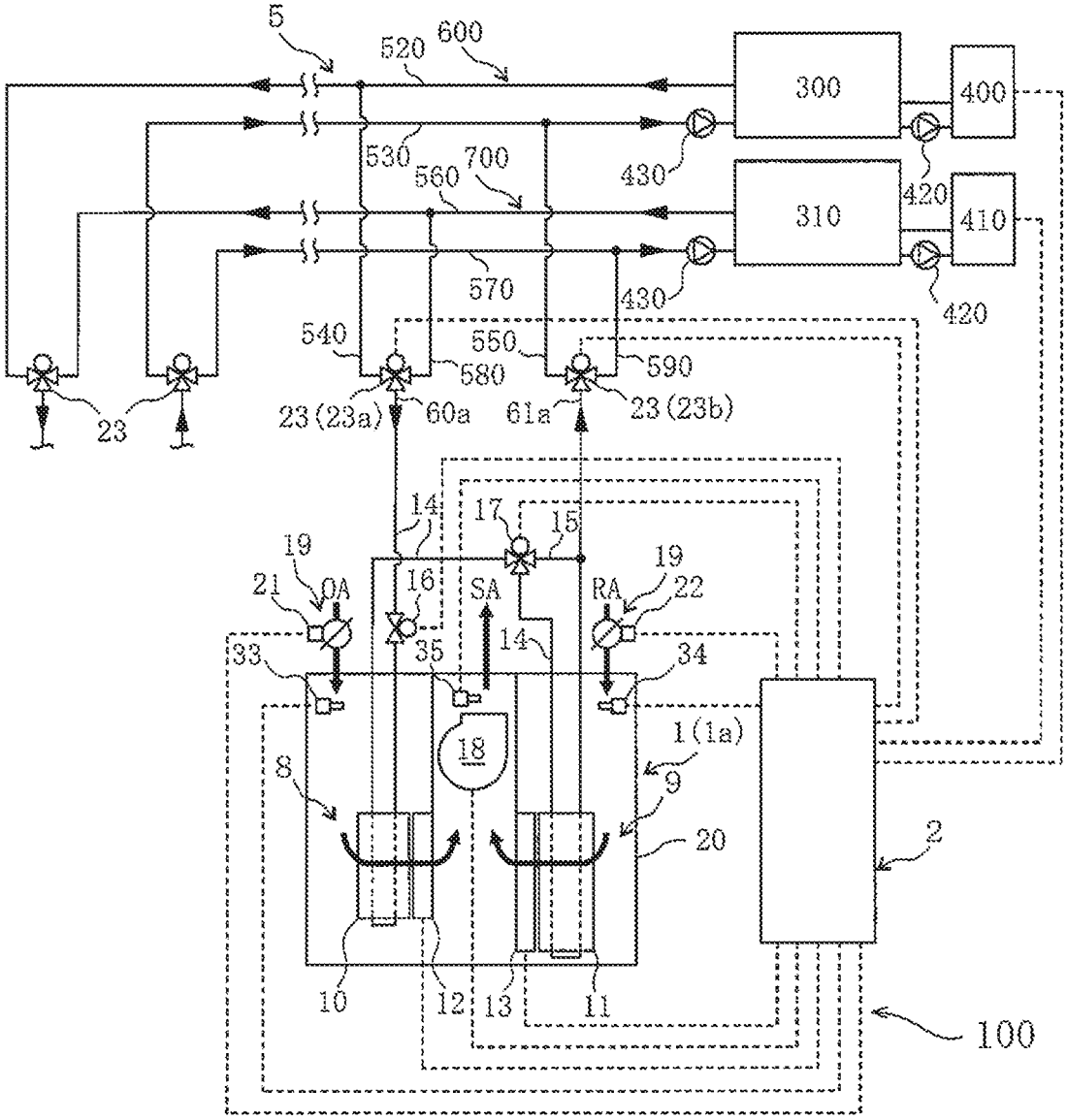
FIG. 8 shows the internal configuration of the air conditioning system according to yet another embodiment.

FIG. 8 shows the air conditioning system 100 according to Embodiment 5. The configuration of the air conditioner 1 of FIG. 8 is the same as the configuration of the air conditioner 1 of FIG. 2. However, the air conditioning system 100 of FIG. 8 includes: a cooling-use heat storage tank 300 configured to store a cooling-use heat exchange medium; a heating-use heat storage tank 310 configured to store a heating-use heat exchange medium; and switching valves 23 configured to switch a passage that is in communication with the air conditioner 1 between a cooling-use circulation passage 600 and a heating-use circulation passage 700. The cooling-use circulation passage 600 is a passage through which the cooling-use heat exchange medium flows, and the heating-use circulation passage 700 is a passage through which the heating-use heat exchange medium flows.

Specifically, the air conditioning system 100 includes the air conditioner 1 and the air conditioner control device 2, and in addition, the cooling-use heat storage tank 300, the heating-use heat storage tank 310, a cooling-use heat source machine 400, a heating-use heat source machine 410, and a circulating apparatus 5.

The cooling-use heat storage tank 300 stores the cooling-use heat exchange medium, such as water, an aqueous solution, or the like whose temperature is in a temperature range suitable for cooling air-conditioning operation of the air conditioner 1. The heating-use heat storage tank 310 stores the heating-use heat exchange medium, such as water, an aqueous solution, or the like whose temperature is in a temperature range suitable for heating air-conditioning operation of the air conditioner 1. The cooling-use heat source machine 400 is a chiller, and the heating-use heat source machine 410 is a boiler. The cooling-use heat source machine 400 is connected to the cooling-use heat storage tank 300 corresponding thereto via one pump 420. The heating-use heat source machine 410 is connected to the heating-use heat storage tank 310 corresponding thereto via another pump 420. The cooling-use heat source machine 400 and the heating-use heat source machine 410 adjust the temperature of the heat exchange medium of the cooling-use heat storage tank 300 and the temperature of the heat exchange medium of the heating-use heat storage tank 310 by performing, for example, nighttime operation.

The circulating apparatus 5 circulates the cooling-use heat exchange medium between the cooling-use heat storage tank 300 and the air conditioner 1, and circulates the heating-use heat exchange medium between the heating-use heat storage tank 310 and the air conditioner 1. The circulating apparatus 5 includes: the cooling-use circulation passage 600, through which the cooling-use heat exchange medium flows; the heating-use circulation passage 700, through which the heating-use heat exchange medium flows; the switching valves 23 configured to switch a passage that is in communication with the air conditioner 1 between the cooling-use circulation passage 600 and the heating-use circulation passage 700; and pumps 430 configured to feed the respective heat exchange media. The switching valves 23 are, for example, solenoid valves that open/close when power thereto is turned on/off.

The cooling-use circulation passage 600 includes a cooling-use forward main conduit 520, a cooling-use return main conduit 530, a cooling-use forward branch conduit 540 branching off from the cooling-use forward main conduit 520, and a cooling-use return branch conduit 550 branching off from the cooling-use return main conduit 530. The heating-use circulation passage 700 includes a heating-use forward main conduit 560, a heating-use return main conduit 570, a heating-use forward branch conduit 580 branching off from the heating-use forward main conduit 560, and a heating-use return branch conduit 590 branching off from the heating-use return main conduit 570. The cooling-use forward branch conduit 540, the heating-use forward branch conduit 580, and a forward conduit portion 60*a* (described below) of the first conduit 14 are connected to each other by one switching valve 23 (23*a*). The cooling-use return branch conduit 550, the heating-use return branch conduit 590, and a return conduit portion 61*a* (described below) of the first conduit 14 are connected to each other by the other switching valve 23 (23*b*). Branching three-way valves are used as the switching valves 23.

Figure 9:
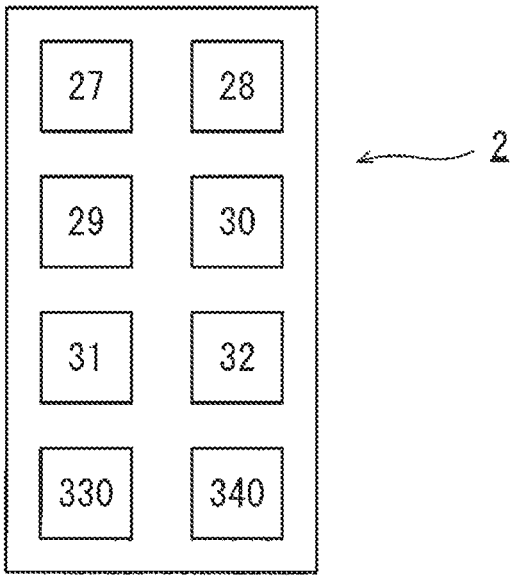
FIG. 9 shows an air conditioner control device of the air conditioning system of FIG. 8.

As shown in FIG. 9, the air conditioner control device 2 includes the air condition detector 27, the temperature/humidity setter 28, the first air conditioning performance controller 29, the air conditioning performance compensator 30, the first vaporizing cooler 31, the outside air cooling controller 32, and in addition, a heat exchange medium switcher 330 and a stored heat temperature adjuster 340.

Assume that there is a difference between an actually measured (detected) air condition (e.g., a temperature) of the space S to be air conditioned and a preset air condition. Here, the heat exchange medium switcher 330: compares the actually measured air condition of the space S to be air conditioned with the preset air condition; based on the comparison result, determines whether to cause the cooling-use heat exchange medium of the cooling-use circulation passage 600 to flow through the air conditioner 1 or to cause the heating-use heat exchange medium of the heating-use circulation passage 700 to flow through the air conditioner 1; and based on the determination result, switches the state of the switching valves 23. Here, the heat exchange medium switcher 330 switches the state of the switching valves 23 after stopping the flow of the heat exchange medium to the air conditioner 1 by the first flow regulating valve 16. For example, if the actually measured temperature of the space S to be air conditioned is higher than the preset temperature, the heat exchange medium switcher 330 causes the cooling-use heat exchange medium to flow through the air conditioner 1. On the other hand, if the actually measured temperature of the space S to be air conditioned is lower than the preset temperature, the heat exchange medium switcher 330 causes the heating-use heat exchange medium to flow through the air conditioner 1. In this manner, the air-conditioning operation to perform is automatically switched between cooling air-conditioning operation and heating air-conditioning operation. Since the state of the switching valves 23 is switched after the flow of the heat exchange medium to the air conditioner 1 is stopped, mixing of the cooling-use heat exchange medium and the heating-use heat exchange medium can be suppressed. This makes it possible to reduce temperature irregularity of the air-conditioning air supplied to the space S to be air conditioned, and reduce uncomfortableness caused thereby. This also makes it possible to reduce temperature changes of the heat exchange medium of the cooling-use heat storage tank 300 and the heat exchange medium of the heating-use heat storage tank 310, and reduce wasteful energy consumption for bringing the temperatures of these heat exchange media back to their preset temperatures.

When the difference between the actually measured (detected) air condition of the space S to be air conditioned and the preset air condition becomes greater than the difference previously measured at the time of switching the state of the switching valves 23, if the air conditioner 1 is performing cooling air-conditioning operation, the stored heat temperature adjuster 340 outputs a signal to lower the temperature range of the heat exchange medium of the cooling-use heat storage tank 300. On the other hand, if the air conditioner 1 is performing heating air-conditioning operation, the stored heat temperature adjuster 340 outputs a signal to raise the temperature range of the heat exchange medium of the heating-use heat storage tank 310. When the difference between the actually measured air condition of the space S to be air conditioned and the preset air condition becomes less than the difference previously measured at the time of switching the state of the switching valves 23, if the air conditioner 1 is performing cooling air-conditioning operation, the stored heat temperature adjuster 340 outputs a signal to raise the temperature range of the heat exchange medium of the cooling-use heat storage tank 300. On the other hand, if the air conditioner 1 is performing heating air-conditioning operation, the stored heat temperature adjuster 340 outputs a signal to lower the temperature range of the heat exchange medium of the heating-use heat storage tank 310. As thus described, in accordance with variation in the air-conditioning load of the space S to be air conditioned, the air-conditioning air can be precisely and finely adjusted to be in suitable air conditions for the air conditioning of the space S to be air conditioned.

It should be noted that the present invention is not limited to the above-described embodiments. For example, the number of air conditioners 1 can be increased or reduced freely. The cooling-use circulation passage 600 and the heating-use circulation passage 700 may be freely modified into any of various types of passage systems, such as a direct return system, a reverse return system, or a combination of these.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. An air conditioning system comprising:

an air conditioner configured to adjust air-conditioning air to be in a suitable air condition for air conditioning of a space to be air conditioned, and supply the air-conditioning air to the space to be air conditioned; and an air conditioner control device configured to control operation of the air conditioner, wherein the air conditioner includes:

an outside air passage, through which outside air flows;

a return air passage, through which return air flows;

an outside air heat exchanger, through which a heat exchange medium flows and at which the outside air of the outside air passage exchanges heat with the heat exchange medium;

a return air heat exchanger, through which the heat exchange medium flows and at which the return air of the return air passage exchanges heat with the heat exchange medium;

an outside air vaporizing humidifier configured to humidify the outside air of the outside air passage by utilizing evaporation of water; and a return air vaporizing humidifier configured to humidify the return air of the return air passage by utilizing evaporation of water, and the air conditioner control device includes a first vaporizing cooler configured to operate one of or both the outside air vaporizing humidifier and the return air vaporizing humidifier to perform vaporization cooling of the air-conditioning air while preventing the air-conditioning air from exchanging heat with the heat exchange medium by stopping a flow of the heat exchange medium in the outside air heat exchanger or the return air heat exchanger.

2. The air conditioning system according to claim 1, further comprising an air volume adjusting device configured to adjust air volume of the outside air of the outside air passage and air volume of the return air of the return air passage, wherein when operating one of or both the outside air vaporizing humidifier and the return air vaporizing humidifier to perform the vaporization cooling of the air-conditioning air, the first vaporizing cooler operates the air volume adjusting device to adjust the air volume of the outside air of the outside air passage and the air volume of the return air of the return air passage.

3. The air conditioning system according to claim 1, further comprising:

a heat storage tank configured to store the heat exchange medium;

a heat source machine configured to adjust a temperature of the heat exchange medium, and switch a temperature range of the heat exchange medium to a temperature range suitable for cooling operation of the air conditioner by cooling the heat exchange medium and to a temperature range suitable for heating operation of the air conditioner by heating the heat exchange medium; and a pump configured to circulate the heat exchange medium between the heat source machine and the air conditioner.

4. The air conditioning system according to claim 1, further comprising:

a cooling-use heat storage tank configured to store a cooling-use heat exchange medium whose temperature is in a temperature range suitable for cooling air-conditioning operation of the air conditioner;

a heating-use heat storage tank configured to store a heating-use heat exchange medium whose temperature is in a temperature range suitable for heating air-conditioning operation of the air conditioner; and a circulating apparatus configured to circulate the cooling-use heat exchange medium between the cooling-use heat storage tank and the air conditioner, and circulate the heating-use heat exchange medium between the heating-use heat storage tank and the air conditioner, wherein the circulating apparatus includes:

a cooling-use circulation passage, through which the cooling-use heat exchange medium flows;

a heating-use circulation passage, through which the heating-use heat exchange medium flows; and a switching valve configured to switch a passage that is in communication with the air conditioner between the cooling-use circulation passage and the heating-use circulation passage, and the air conditioner control device includes a heat exchange medium switcher configured to:

compare an actually measured air condition of the space to be air conditioned with a preset air condition;

based on a comparison result, determine whether to cause the cooling-use heat exchange medium whose temperature is in the temperature range suitable for the cooling air-conditioning operation to flow through the air conditioner or to cause the heating-use heat exchange medium whose temperature is in the temperature range suitable for the heating air-conditioning operation to flow through the air conditioner; and based on a determination result, switch a state of the switching valve.

5. The air conditioning system according to claim 4, wherein the air conditioner control device includes a stored heat temperature adjuster, when a difference between the actually measured air condition of the space to be air conditioned and the preset air condition becomes greater than the difference previously measured at a time of switching the state of the switching valve, if the air conditioner is performing the cooling air-conditioning operation, the stored heat temperature adjuster outputs a signal to lower the temperature range of the heat exchange medium of the cooling-use heat storage tank, and if the air conditioner is performing the heating air-conditioning operation, the stored heat temperature adjuster outputs a signal to raise the temperature range of the heat exchange medium of the heating-use heat storage tank, and when the difference between the actually measured air condition of the space to be air conditioned and the preset air condition becomes less than the difference previously measured at the time of switching the state of the switching valve, if the air conditioner is performing the cooling air-conditioning operation, the stored heat temperature adjuster outputs a signal to raise the temperature range of the heat exchange medium of the cooling-use heat storage tank, and if the air conditioner is performing the heating air-conditioning operation, the stored heat temperature adjuster outputs a signal to lower the temperature range of the heat exchange medium of the heating-use heat storage tank.

6. An air conditioning system comprising:

an air conditioner configured to adjust air-conditioning air to be in a suitable air condition for air conditioning of a space to be air conditioned, and supply the air-conditioning air to the space to be air conditioned; and an air conditioner control device configured to control operation of the air conditioner, wherein the air conditioner includes:

an outside air passage, through which outside air serving as the air-conditioning air flows;

a return air passage, through which return air serving as the air-conditioning air flows;

an outside air heat exchanger, at which the outside air of the outside air passage exchanges heat with a heat exchange medium;

a return air heat exchanger, at which the return air of the return air passage exchanges heat with the heat exchange medium;

a steam humidifier configured to humidify, between the air-conditioning air of the outside air passage and the air-conditioning air of the return air passage, at least the air-conditioning air of the outside air passage, which is the outside air, by utilizing steam; and a return air vaporizing humidifier configured to humidify the return air of the return air passage by utilizing evaporation of water, and the air conditioner control device includes:

a humidifying heater configured to operate the steam humidifier to heat the air-conditioning air while preventing the air-conditioning air from exchanging heat with the heat exchange medium; and a second vaporizing cooler configured to operate the return air vaporizing humidifier to perform vaporization cooling of the return air while preventing the air-conditioning air from exchanging heat with the heat exchange medium.

* * * * *